US006619344B2

(12) United States Patent
Schönfelder et al.

(10) Patent No.: US 6,619,344 B2
(45) Date of Patent: Sep. 16, 2003

(54) DEVICE FOR FILLING AN INK CARTRIDGE

(75) Inventors: Volker Schönfelder, Aurachtal (DE); Günther Tandler, Oberasbach (DE); Thomas Bothe, Nürnberg (DE)

(73) Assignee: J. S. Staedtler GmbH & Co., Nürnberg (DE)

( * ) Notice: Subject to any disclaimer, the term of this patent is extended or adjusted under 35 U.S.C. 154(b) by 0 days.

(21) Appl. No.: 10/108,746

(22) Filed: Mar. 28, 2002

(65) Prior Publication Data

US 2002/0139441 A1 Oct. 3, 2002

(30) Foreign Application Priority Data

Apr. 2, 2001 (DE) ..... 101 16 429

(51) Int. Cl.[7] ..... B41J 2/175

(52) U.S. Cl. ..... 141/330; 141/285; 141/18; 141/316; 141/329; 141/375; 141/364; 222/81; 222/325; 347/87

(58) Field of Search ..... 141/10, 18, 21, 141/25, 313–317, 285, 329, 330, 363–366, 375; 222/87–88, 92, 93, 95, 96, 105, 325–327, DIG. 1; 347/85–87

(56) References Cited

U.S. PATENT DOCUMENTS

| | | | | | |
|---|---|---|---|---|---|
| 3,482,258 | A | * | 12/1969 | Steen | 346/140.1 |
| 4,183,031 | A | * | 1/1980 | Kyser et al. | 347/86 |
| 4,700,202 | A | * | 10/1987 | Kuranishi et al. | 347/86 |
| 5,315,317 | A | * | 5/1994 | Terasawa et al. | 347/7 |
| 5,329,294 | A | * | 7/1994 | Ontawar et al. | 347/87 |
| 5,595,223 | A | | 1/1997 | Hayao | |
| 5,721,576 | A | * | 2/1998 | Barinaga | 347/85 |
| 5,845,682 | A | * | 12/1998 | Hayao | 141/18 |
| 5,971,532 | A | * | 10/1999 | Toda | 347/86 |
| 5,996,844 | A | * | 12/1999 | Ito | 222/85 |
| 6,243,115 | B1 | * | 6/2001 | Baker et al. | 347/85 |
| 6,478,415 | B2 | * | 11/2002 | Barinaga et al. | 347/85 |

FOREIGN PATENT DOCUMENTS

| | | |
|---|---|---|
| DE | 4434186 | 3/1998 |
| DE | 199 12 620 A1 | 10/2000 |
| EP | 0847861 | 6/1998 |

* cited by examiner

*Primary Examiner*—J. Casimer Jacyna
(74) *Attorney, Agent, or Firm*—Friedrich Kueffner

(57) ABSTRACT

A device for filling an ink cartridge, particularly a refilling device for filling ink cartridges of ink-jet systems, such as printers and plotters, or other automatic registering, writing or drawing apparatus, includes a refilling container and an ink cartridge connected through an adaptor and arranged essentially one above the other in the filling position. The adaptor has at least two connections for the refilling container and the cartridge to be connected. A separate ink reservoir is arranged in the ink cartridge, wherein the ink reservoir of the ink cartridge and/or the filling container of the refilling container includes an easily deformable bag, and wherein the reservoir bag and/or container bag are of a flexible, elastic material. A hermetically sealed cartridge space is formed between the cartridge housing and the separate ink reservoir. The adaptor is constructed and dimensioned in such a way, that, together with the ink cartridge and the refilling container, the adaptor forms in the filling position a hermetically closed filling system and an additional air system between the hermetically sealed cartridge space and the atmosphere.

10 Claims, 4 Drawing Sheets

DEVICE FOR FILLING AN INK CARTRIDGE

BACKGROUND OF THE INVENTION

1. Field of the Invention

The present invention relates to a device for filling an ink cartridge, particularly a refilling device for filling ink cartridges of ink-jet systems, such as printers and plotters, or other automatic registering, writing or drawing apparatus.

2. Description of the Related Art

Refilling devices for filling containers or ink cartridges are known in principle in the art. For example, there are refilling systems for filling ink reservoirs of ink-jet systems and plotters or for other automatic registering, writing or drawing apparatus, by means of which it is possible to refill an empty ink cartridge of the printing heads or the recording pens with new ink or other recording medium.

U.S. Pat. No. 5,595,223 discloses an ink refilling device which includes an adaptor which is arranged on a printing head, wherein it is possible by means of the adaptor to open the ink cartridge of the printing head, on the one hand, and to close, pierce and fasten a refilling container. When the container is opened or pierced, the closing components are separated or destroyed, so that the ink can flow from the container into the cartridge. The air equalization between the cartridge to be filled and in the refilling container through the cartridge takes place through air ducts which open to atmosphere. For filling the cartridge, the refilling container must be arranged over or above the adaptor, so that the ink can flow automatically due to gravity from the container into the cartridge. Such a device in the form of this adaptor has the disadvantage that it is not possible with this adaptor to refill a hermetically sealed cartridge, or a cartridge without permanently open air equalization, because of the counter pressure which builds up.

DE 199 12 620 A1 discloses devices and arrangements in which refilling containers are connected to an ink cartridge through an adaptor, wherein the components are essentially arranged one above the other in the filling position. The filling procedure takes place through the force of gravity because the ink bag which may be present in the ink cartridge can unfold unimpededly as soon as ink flows into it. These devices have the disadvantage that refilling of the ink cartridge is only possible and operationally feasible as long as no counter pressure prevails or is built up in the ink cartridge which is on a lower level.

Such a counter pressure would prevail or build up, for example, if the ink bag of these devices were surrounded by a housing which is hermetically sealed to the outside. In that case, refilling of the ink cartridge with these devices would not be possible because of the counter pressure which is being built up, even if auxiliary means such as pumps are used. In accordance with another solution shown in this reference, only an internal pressure equalization takes place between two inflexible and rigidly connected ink cartridges through simple air openings.

SUMMARY OF THE INVENTION

Therefore, it is the primary object of the present invention to provide a device for refilling ink cartridges which does not have the above-mentioned disadvantages of the prior art and which makes it possible in an inexpensive, simple and clean manner to refill cartridges which are difficult to refill, such as hermetically sealed cartridge systems.

By providing a refilling device, it is possible to reuse empty cartridges, either with or without printing heads, which is environmentally friendly by reducing waste and which, in addition, may save costs for the user.

In accordance with the present invention, a device is provided in which a refilling container and an ink cartridge are connected through an adaptor and are arranged essentially one above the other in the filling position, and wherein the adaptor has at least two connections for the refilling container and the cartridge to be connected. A separate ink reservoir is arranged in the ink cartridge, wherein the ink reservoir of the ink cartridge and/or the filling container of the refilling container includes an easily deformable bag, and wherein the reservoir bag and/or the container bag are of a flexible, elastic material, particularly a highly flexible polymer material. A hermetically sealed cartridge space is formed between the cartridge housing and the separate ink reservoir. The adaptor is constructed and dimensioned in such a way that, together with an ink cartridge to be refilled and a suitable refilling container, the adaptor forms in the filling position, i.e., in the assembled state, a hermetically closed filling system and an additional air system between the hermetically sealed cartridge space and the atmosphere.

The various features of novelty which characterize the invention are pointed out with particularity in the claims annexed to and forming a part of the disclosure. For a better understanding of the invention, its operating advantages, specific objects attained by its use, reference should be had to the following descriptive matter in which there are described preferred embodiments of the invention.

DETAILED DESCRIPTION OF THE INVENTION

Figure 1:
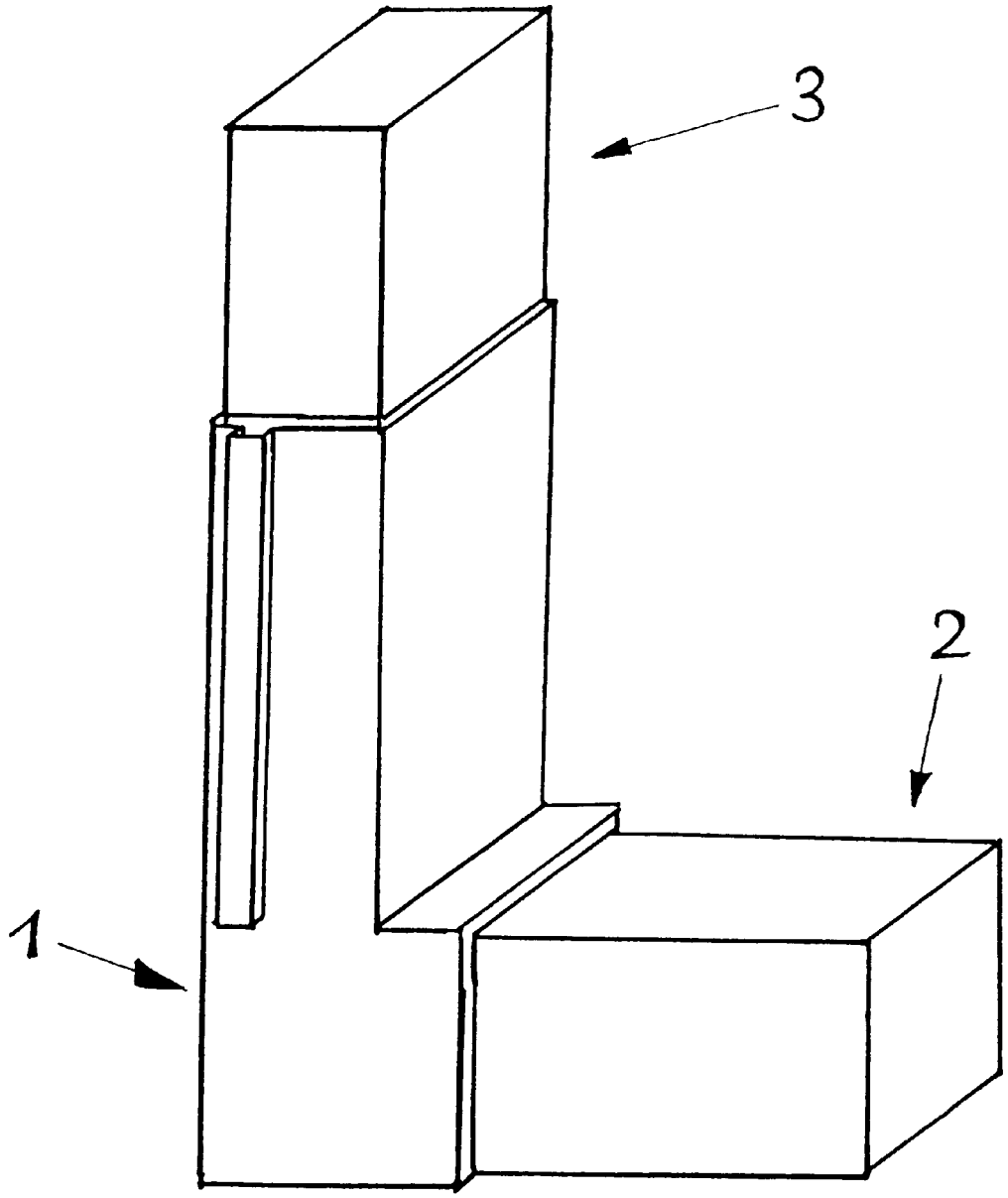
FIG. 1 is a schematic perspective front view of an adaptor connected to a refilling container and an ink cartridge.

FIG. 1 schematically shows a device according to the present invention, wherein an ink cartridge 2 to be refilled and a refilling container 3 containing an ink supply are inserted into an adaptor 1.

Figure 2:
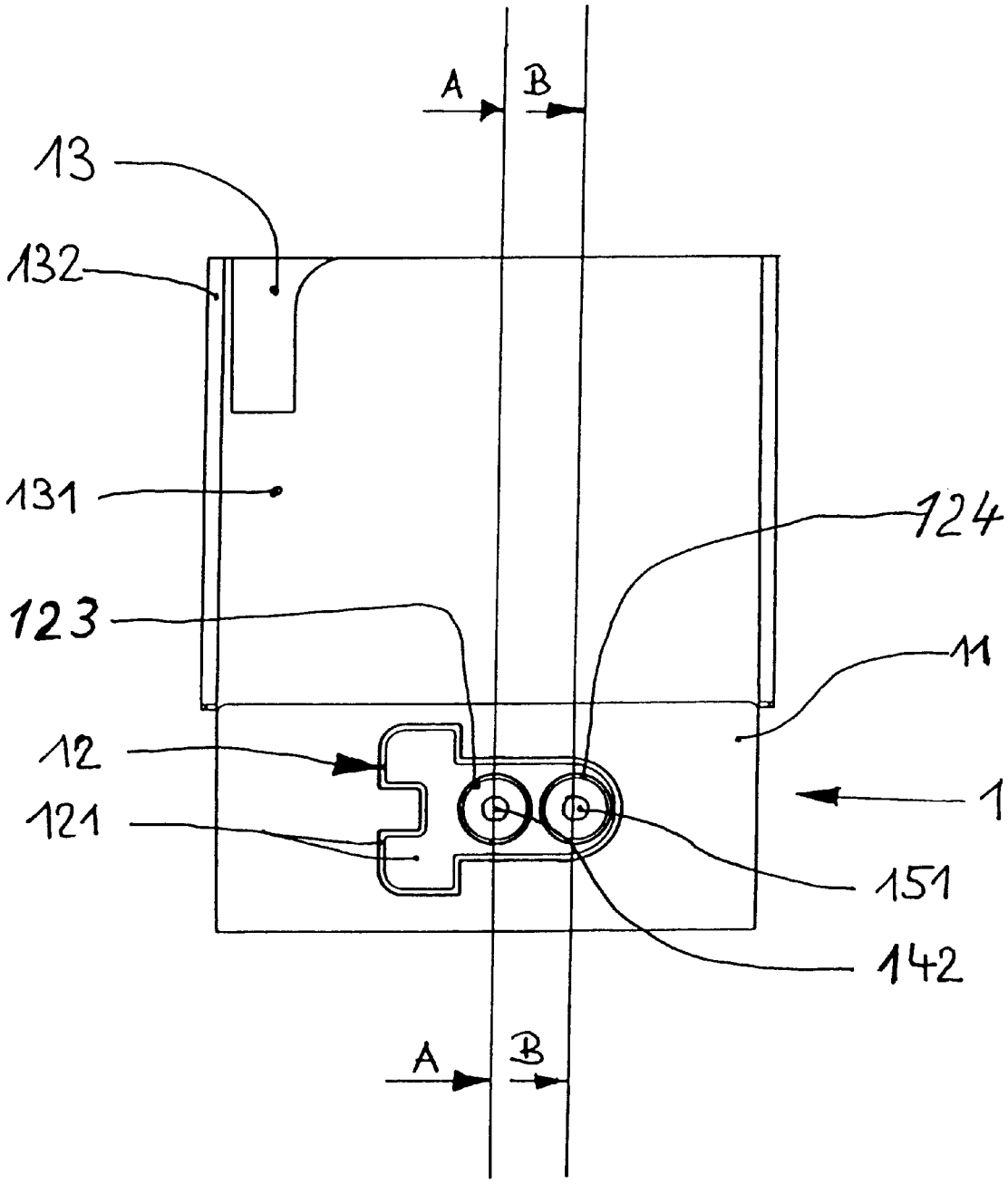
FIG. 2 is a schematic front view of an adaptor without ink cartridge and without refilling container.

FIG. 2 shows the adaptor 1 in an elevational view as a separate component. The ink cartridge shown in FIG. 1 can be connected to the adaptor 1. A cartridge connection 12 in the form of a plug-in connection is arranged at the distributor housing 11 of the adaptor 1. The cartridge connection 12 is composed of a connection member 121 and a filling connection 123 with a cartridge cannula 142 and an air connection 124 with air cannula 151. A refilling container 3, shown in FIG. 1, can be inserted into the connector housing 131 at the container connection 13. Arranged laterally on the connector housing 131 are guide grooves 132 which can be engaged by centering projections or cams of the refilling container 3, for example, for identification of matching components of defined filling systems. If the adaptor is to be suitable always only for a certain type of ink or device, the shape or positions of the grooves and projections may be arranged differently.

Figure 3:
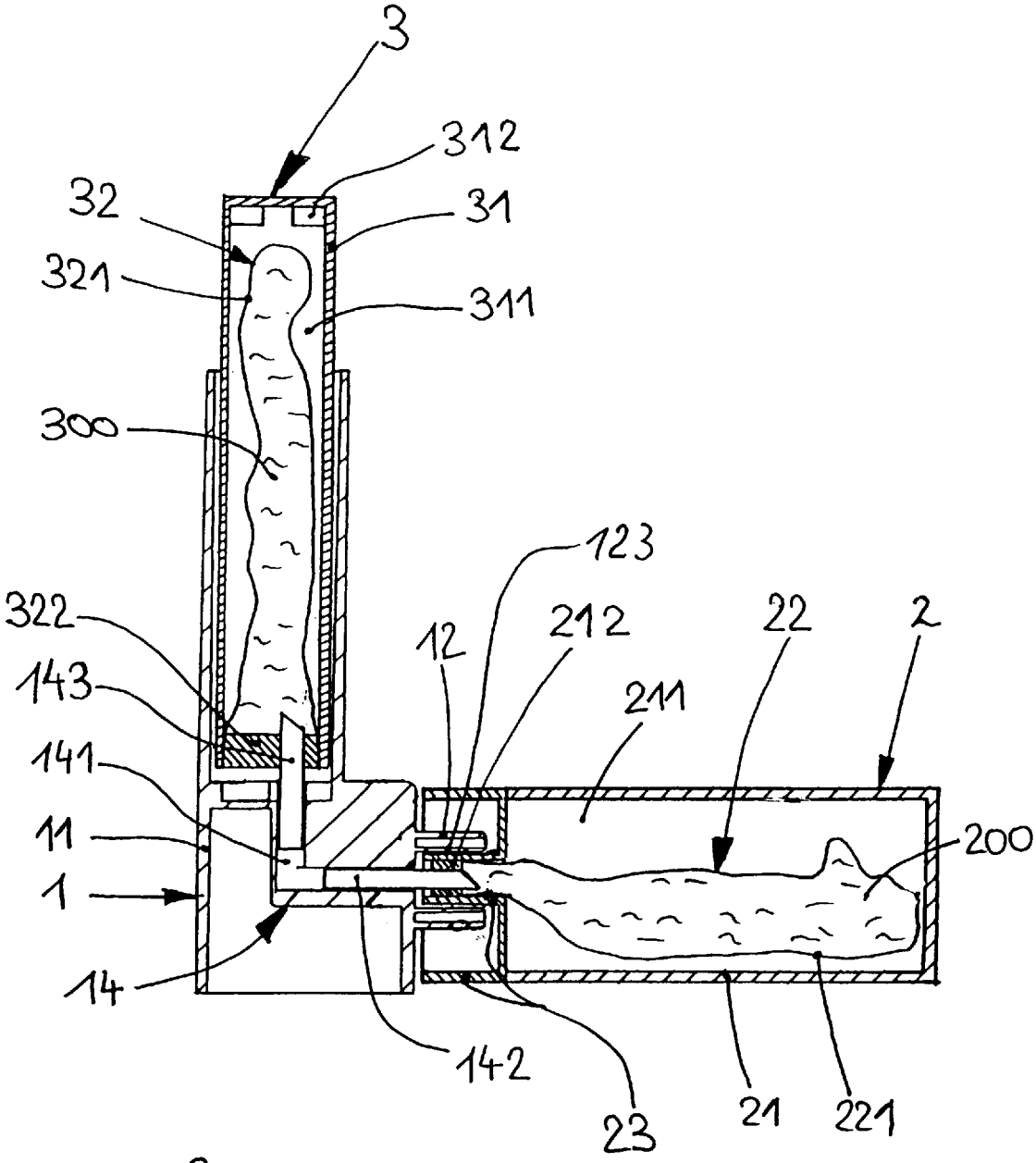
FIG. 3 is a sectional view of the device of FIG. 1 taken along sectional line A—A of FIG. 2.

FIG. 3 shows the situation in which filling takes place, wherein a refilling container 3 and an ink cartridge 2 are mounted on the distributor housing 11 of the adaptor 1.

The opening 23 of the ink cartridge 2 is placed on the cartridge connection 12 of the adaptor 1 and is connected with frictional engagement to the filling connection 123 of the adaptor 1. The refilling ink 300 flows through the filling system 14, i.e., the container cannula 143, the filling duct 141 and the cartridge cannula 142, into the cartridge reservoir 22 of the ink cartridge 2 where it is received as reusable ink 200. The cartridge cannula 142 of the cartridge and the container cannula 143 of the refilling container are firmly inserted into the filling duct 141 after piercing tips or inclined pressure surfaces of the cannulas have penetrated through the cartridge seal 212 in the cartridge opening 23 and the container seal 322 in the container bag 321; as a result, a continuous ink flow is possible.

The ink reservoir 22 defined by a reservoir bag 221 is placed within the ink housing 21 in the hermetically sealed ink space 211. To ensure that during the refilling procedure the soft filling container 32 defined in the container housing 31 by the container bag 321 can unimpededly collapse as it is emptied, at least one container opening 312 is arranged in the container housing 31 for venting the container space 311.

Figure 4:
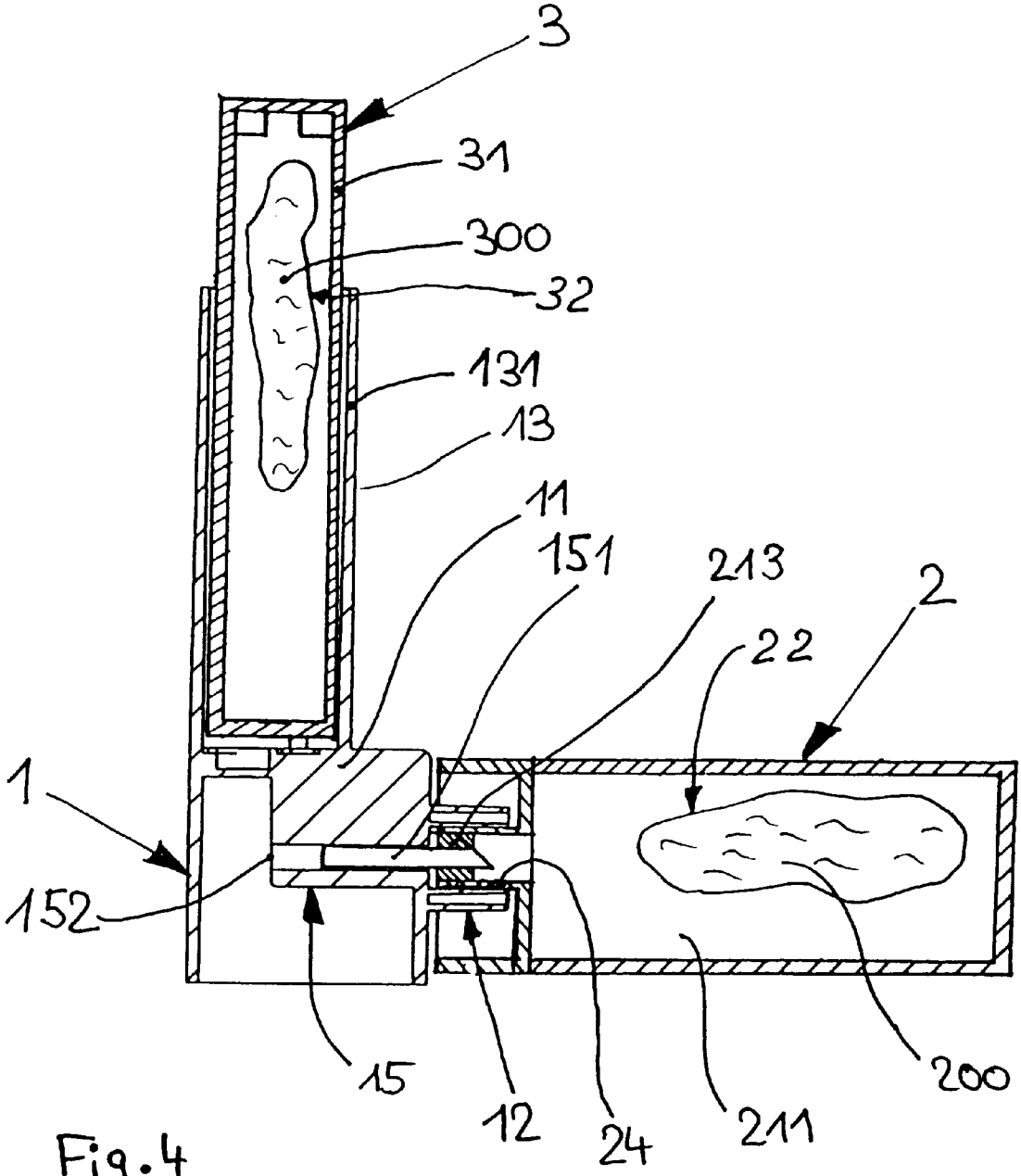
FIG. 4 is a sectional view of the device of FIG. 1 taken along sectional line B—B of FIG. 2.

FIG. 4 of the drawing shows the device of FIG. 3 with the adaptor 1, the ink cartridge 2 and the refilling container 3, wherein, however, the section is taken through the venting system 15 of the device. The venting system 15 integrated in the distributor housing 11 includes a fixedly mounted air cannula 151 directed toward the ink cartridge 2 and provides free passage of air to the atmosphere through an air opening 152. Consequently, a pressure equalization takes place to the atmosphere and an amount of air escapes during the filling procedure from the otherwise hermetically sealed cartridge space 211 of the ink cartridge 2 which is equal in volume to the quantity of refilling medium 300 which flows from the filling container 32 as newly usable writing medium 200 into the ink reservoir 22. When the adaptor is connected, the air cannula 151 penetrates with its piercing tip the air seal 213 fixedly arranged in the opening 24 and, thus, opens the otherwise hermetically sealed reservoir space 211 in the ink cartridge 2. While the ink cartridge 2 is connected through the cartridge connection 12 to the distributor housing 11 of the adaptor 1 in a frictionally engaging but releasable manner, the container housing 31 of the refilling container 3 is mounted in the connector housing 131 of the container connection 13 in a sealed manner but with a relatively loose seat.

The device according to the present invention for filling an ink cartridge, particularly an ink cartridge in an ink-jet system, a printer, plotter or other automatic registering, writing or drawing installation, includes a refilling container 3 and the ink cartridge 2 is connected to the refilling container 3 through an adaptor 1 and the components are arranged in the filling position essentially one above the over. The adaptor 1 includes at least two connections for the container 3 and cartridge 2 to be connected, and an ink reservoir 22 is arranged in the ink cartridge 2, wherein a hermetically sealed cartridge space 211 is formed between the cartridge housing 21 and the ink reservoir 22. In such a device, the adaptor 1 is preferably constructed and dimensioned in such a way that, together with an ink cartridge 2 to be refilled and a suitable refilling container 3, the adaptor 1 forms a hermetically sealed filling system 14 in the filling position, i.e., when the components are assembled, wherein the device includes an additional venting system 15.

It is additionally advantageous if the filling system 14 includes at least one cartridge cannula 142 and at least one container cannula 143 each arranged in a filling duct 141, wherein, in the filling position with the ink cartridge 2 being closed and the refilling container 3 being mounted, a fluidic connection is produced by the cannulas between the interior of the filling container 32 and the interior of the ink reservoir 22.

The venting system 15 preferably includes an air cannula 151 which provides in the filling position, for example, through an air opening 152, an air passage between the interior of the hermetically sealed cartridge space 211 and the atmosphere.

The entire device is particularly stable and easy to manipulate if the adaptor 1 has a distributor housing 11 of strong bending resistant material and at least a cartridge connection 12 and/or a container connection 13 also of a strong bending-resistance material, and if the ink cartridge 2 and/or the refilling container 3 are also of a strong bending-resistant material.

The sealing elements 212, 213, 322 should be mounted on the ink reservoir 22, in the ink cartridge 2, in the refilling container 3 and/or in the connecting areas of the adaptor 1 directly at the adaptor 1, and during the refilling procedure, at least one sealing connection should be effected between the sealing elements 212, 213, 322 and the cannulas 142, 143, 151 arranged in the adaptor 1.

By providing the cannulas 142, 143, 151 each with a bending-resistant piercing tip, the corresponding closures at the ink cartridge 2 and/or the refilling container 3 can be opened particularly easily.

In accordance with an advantageous feature of these systems, the ink reservoir 22 of the ink cartridge 2 and/or the filling container 32 of the refilling container 3 include an easily deformable bag 221, 321, wherein, for example, the reservoir bag 221 and/or the container bag 321 should be composed of a flexible, elastic material, preferably a highly flexible polymer material.

The sealing elements 212, 213, 322 can and should be constructed of rubber or soft plastics material and in the form of discs or rings and/or as self-closing valves.

The connecting means at the cartridge connection 12 and/or the container connection 13 of the adaptor 1 should each be complementary to the ink cartridge 2 and refilling container 3 to be connected in the form of plug-type connections, positively engaging connections or threaded connections.

The present invention provides a device in which an adaptor 1 produces a fluidic connection through a filling system 14 between an ink cartridge 2 to be refilled and a refilling container 3 through coupling elements. During refilling, the liquid level of the refilling container 3 is above the level of the ink cartridge 2, so that the refilling procedure takes place as a result of gravity. For effecting a problem-free filling procedure, simultaneously with the fluidic connection it is necessary to produce a pressure equalization or an opening to the atmosphere of the hermetically sealed cartridge space 211 which is located between the outer surface of the ink reservoir 22 and the inner surface of the cartridge housing 21. This connection is effected through a venting system 15 in the adaptor 1.

Consequently, the adaptor 1 simultaneously serves to produce a fluidic connection and a pressure equalization.

In the refilling container 3 as well as in the ink cartridge 2 with the ink reservoir 22, the connections to the sealing elements 212, 213 and 322 are closed, for example, through separations or valves. When the refilling container 3 with the filling container 32 and the ink cartridge 2 with the ink reservoir 22 are plugged into the adaptor 1, the sealing elements 212, 213, 322 are pierced by the cannulas 142, 143 and 151.

When the filled ink reservoir 22 and the empty or partially empty filling container 32 are separated or pulled from the adaptor 1 after the conclusion of the refilling procedure, the sealing elements 212, 213, 322 close automatically as soon as the coupling elements have been removed. This safely prevents any unintentional discharge of liquids, such as ink 200 or other refilling medium 300, and any attendant contaminations.

In order to prevent mixups when a refilling container 3 or an ink cartridge 2 which contain inks of different colors or inks for different purposes, in the adaptor 1, the container connections 13 of the adaptor 1 may include elements such as guide grooves 132 which interact with corresponding elements at the refilling container 3 or the ink cartridge 2, for example, projections or cams, for example in accordance with the so called tongue and groove principle.

The refilling procedure should advantageously be started by initially safely connecting and opening the empty ink cartridge 2 with the adaptor 1 and only then to connect and open the refilling container 3. The filling quantities of the ink cartridge 2 and the refilling container 3 should be adjusted to each other in such a way that the contents of the refilling container 3 are completely filled into the ink cartridge 2 during a filling procedure. Otherwise it would be advantageous to provide locking valves or other proportioning aids and/or content and filling indicators.

After the filling procedure, the three components adaptor 1, ink cartridge 2 and refilling container 3 are once again separated from each other, preferably by vertically directed pulling movements. The three seals 213, 212 and 322 are then advantageously closed, preferably in this sequence, in an airtight and liquid-tight manner. If the connecting lengths of the cartridge opening 23 and the air opening 24 are equal and the free contact length of the air cannula 151 is shorter than the free connecting length of the cartridge cannula 142, a relatively contamination-free separation of the ink cartridge 2 in the predetermined sequence is made possible if the ink cartridge 2 is removed before the refilling container 3.

The invention is not limited by the embodiments described above which are presented as examples only but can be modified in various ways within the scope of protection defined by the appended patent claims.

We claim:

1. In a device for filling an ink cartridge, particularly a refilling device for filling ink cartridges of ink-jet systems, such as printers and plotters, or other automatic registering, rating or drawing apparatus, wherein the device includes an adaptor configured to be connected to a refilling container and an ink cartridge, wherein the refilling container is arranged above the ink cartridge in a filling position, and wherein the adaptor has at least two connections for the refilling container and the ink cartridge, a separate ink reservoir being arranged in the ink cartridge and a filling container being arranged in the refilling container, wherein the ink reservoir of the ink cartridge and the filling container of the refilling container are easily deformable bags, wherein the reservoir bag and the container bag are of a flexible, elastic material, the improvement comprising a hermetically sealed cartridge space formed between the cartridge housing and the separate ink reservoir, the adaptor forming in the filling position together with the ink cartridge to be refilled and the refilling container a hermetically closed filling system and an additional air system between the hermetically sealed cartridge space and atmosphere.

2. The device according to claim 1, wherein the filling system of the adaptor comprises a cartridge cannula arranged in a filling duct and a container cannula for effecting a fluidic connection in the filling position between an interior of the filling container and the ink reservoir.

3. The device according to claim 2, wherein the air system of the adaptor comprises an air cannula for effecting through an air opening an air passage between an interior of the hermetically sealed cartridge space and atmosphere.

4. The device according to claim 3, wherein the adaptor comprises sealing elements adjacent the ink reservoir, the ink cartridge and the refilling container, and wherein in the filling position a sealing connection is effected between the cannulas and the sealing elements.

5. The device according to claim 4, wherein the sealing elements are comprised of discs or rings of rubber or soft plastics material.

6. The device according to claim 4, wherein the sealing elements are comprised of self-closing valves.

7. The device according to claim 3, wherein each cannula comprises at least one bending-resistant piercing tip for opening at least one of the connections at the ink reservoir, the refilling container and the cartridge space.

8. The device according to claim 1, wherein the adaptor comprises a distributor housing with a cartridge connection and a container connection, wherein the adaptor and the connections are of a strong bending-resistant material.

9. The device according to claim 1, wherein the ink cartridge and the refilling container are of a strong bending-resistant material.

10. The device according to claim 1, wherein the ink cartridge and the refilling container are connected to the adaptor through plug-in connections, positively engaging connections or threaded connections.

* * * * *